US010421295B2

(12) United States Patent
Ito

(10) Patent No.: US 10,421,295 B2
(45) Date of Patent: Sep. 24, 2019

(54) INK JET RECORDING APPARATUS AND CONTROL METHOD OF INK JET RECORDING APPARATUS

(71) Applicant: CANON KABUSHIKI KAISHA, Tokyo (JP)

(72) Inventor: Akira Ito, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/913,104

(22) Filed: Mar. 6, 2018

(65) Prior Publication Data

US 2018/0264850 A1 Sep. 20, 2018

(30) Foreign Application Priority Data

Mar. 16, 2017 (JP) ..... 2017-051707

(51) Int. Cl.

| | |
|---|---|
| ***B41J 11/00*** | (2006.01) |
| ***B41J 29/46*** | (2006.01) |
| ***B41J 2/175*** | (2006.01) |
| ***B41J 29/02*** | (2006.01) |
| ***B41J 29/38*** | (2006.01) |
| *B41J 13/00* | (2006.01) |

(52) U.S. Cl.

CPC ..... *B41J 11/006* (2013.01); *B41J 2/17546* (2013.01); *B41J 29/02* (2013.01); *B41J 29/38* (2013.01); *B41J 29/46* (2013.01); *B41J 13/0027* (2013.01)

(58) Field of Classification Search

CPC ..... B41J 11/006; B41J 2/17546; B41J 29/02; B41J 29/38; B41J 29/46

See application file for complete search history.

(56) References Cited

U.S. PATENT DOCUMENTS

2007/0248365 A1* 10/2007 Gettelfinger ..... B65H 3/0684 399/16
2017/0100950 A1* 4/2017 Arakane ..... B41J 2/04556

FOREIGN PATENT DOCUMENTS

| | | | |
|---|---|---|---|
| JP | 2010-274442 | A | 12/2010 |
| JP | 2013-067085 | A | 4/2013 |
| JP | 2014-058391 | A | 4/2014 |

* cited by examiner

*Primary Examiner* — Lamson D Nguyen

(74) *Attorney, Agent, or Firm* — Canon U.S.A., Inc. IP Division

(57) ABSTRACT

An ink jet recording apparatus includes a recording unit, a plurality of rollers, and a notice control unit. The recording unit records an image on a sheet by causing a carriage mounted with a recording head to scan. The plurality of rollers presses the sheet. The notice control unit controls an error notice. In a case an error occurs in the recording unit, the notice control unit controls the error notice based on a relative position of the sheet with respect to the plurality of rollers at a time of occurrence of the error.

20 Claims, 8 Drawing Sheets

FIG. 5A

SHEET MAY BE JAMMED.
OPEN FRONT COVER.

113

FIG. 5B

REMOVE SHEET.
AFTER REMOVAL, PRESS END BUTTON.

END 115

114

FIG. 5C

REMOVAL OPERATION IS COMPLETED.
CLOSE FRONT COVER.

116

FIG. 5D

CHECKING IS BEING PERFORMED.
WAIT FOR A WHILE.

117

FIG. 5E

REMOVAL OF SHEET IS
NORMALLY COMPLETED.

118

FIG. 5F

SERVICE ERROR OCCURS.
TURN OFF POWER AND REQUEST REPAIR.

119

INK JET RECORDING APPARATUS AND CONTROL METHOD OF INK JET RECORDING APPARATUS

BACKGROUND OF THE INVENTION

Field of the Invention

The present disclosure relates to an ink jet recording apparatus that records image on a recording medium by using a recording head and a control method of an ink jet recording apparatus.

Description of the Related Art

In a printing apparatus, a jam may occur when a recording paper comes into contact with a carriage unit during printing. Generally, in such a case, the printing apparatus can be restored when a user removes paper. For example, an opening/closing door is included in a conveying path, and removal of the paper from the opening/closing door is prompted, or a guidance of how to remove paper is displayed on a liquid crystal screen.

Japanese Patent Laid-Open No. 2014-58391 describes that if a residual sheet remains in a conveying path when a jam occurs, information detected by a configuration for detecting a position of the residual sheet is displayed on an operation display unit, as a configuration for a user to remove a sheet. According to Japanese Patent Laid-Open No. 2014-58391, it is possible to cause the user to grasp a state of the residual sheet (position and whether or not the residual sheet can be automatically discharged) by such a configuration.

However, in Japanese Patent Laid-Open No. 2014-58391, a configuration for detecting the position of the residual sheet is required, and the residual sheet may be difficult for the user to remove depending on the position of the residual sheet, however, even in such a case, removal processing of the residual sheet is guided.

SUMMARY OF THE INVENTION

According to an aspect of the present disclosure, an ink jet recording apparatus includes a recording unit configured to record an image on a sheet by causing a carriage mounted with a recording head to scan, a plurality of rollers configured to press the sheet, and a notice control unit configured to control an error notice wherein, in a case an error occurs in the recording unit, the notice control unit controls the error notice based on a relative position of the sheet with respect to the plurality of rollers at a time of occurrence of the error.

Further features of the present disclosure will become apparent from the following description of exemplary embodiments (with reference to the attached drawings).

BRIEF DESCRIPTION OF THE DRAWINGS

FIGS. 5A-5F are diagrams showing user interface screens.

DESCRIPTION OF THE EMBODIMENTS

Figure 1:
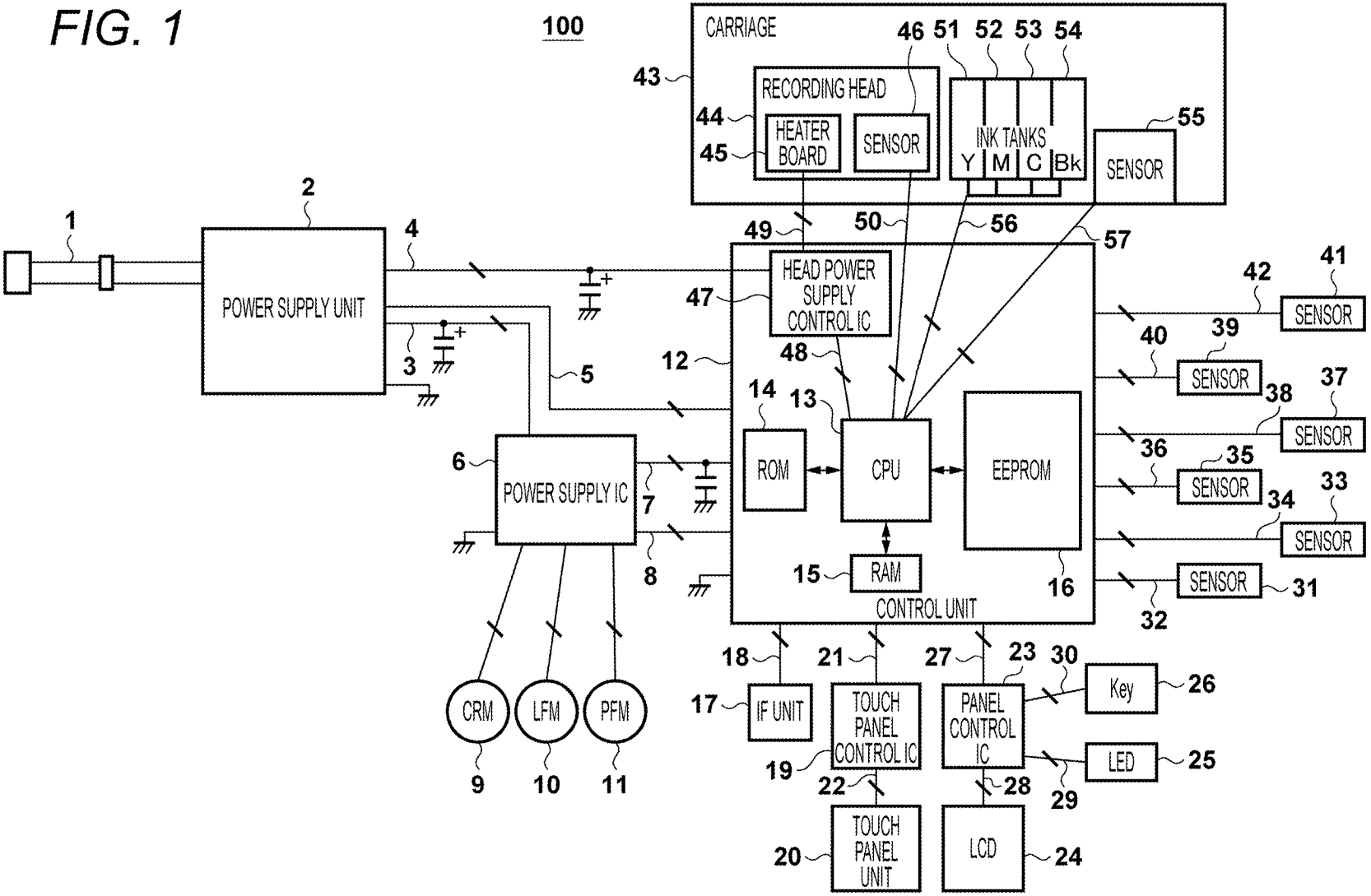
FIG. 1 is a diagram showing a configuration of a recording apparatus.

Hereinafter, an embodiment will be described in detail with reference to the drawings. The embodiment described below does not limit the scope of the claims. Further, all combinations of features described in the embodiment are not necessarily essential. The same reference numerals are given to the same constituent elements and the description thereof will be omitted.

FIG. 1 is a diagram showing a configuration of a recording apparatus. In the embodiment, for example, a serial type ink jet recording apparatus (ink jet printer) is used as the recording apparatus. However, a multi-function peripheral where a plurality of functions such as a scanner are integrated may be used as long as the recording apparatus is a serial type ink jet printer.

Electric power is supplied through an AC cable 1. A power supply unit 2 converts supplied AC power into DC power. The converted DC power is transmitted to a power supply IC 6 through a DC power supply line 3 and converted into a DC voltage. Similarly, second system DC power that is converted into DC power by the power supply unit 2 is supplied to a control unit 12 for driving a recording head through a power supply line 4. The DC voltage converted by the power supply IC 6 is supplied to the control unit 12 through a DC power supply line 7. The power supply IC 6 is controlled through a DCDC control line 8.

The control unit 12 integrally controls an entire recording apparatus 100 and includes a CPU 13, a ROM 14 that stores a program and data, a RAM 15 used as a working area, and an EEPROM 16 that stores settings of the apparatus and the like. The CPU 13 may be an ASIC incorporating a microcomputer. The power supply IC 6 is controlled by the control unit 12 and drives a plurality of motors 9, 10, and 11. The motors 9, 10, and 11 are a motor that drives a carriage 43, a motor that drives a conveying roller for conveying paper, and a motor that drives a paper feeding roller for feeding paper, respectively.

The control unit 12 transmits and receives data to and from an external computer and an external network through an interface (IF) unit 17. A user interface of the recording apparatus 100 includes an LCD 24, a touch panel unit 20, a key 26, and an LED 25. The LCD 24, the touch panel unit 20, and the LED 25 display a user interface screen or the like corresponding to apparatus information and various functions. The touch panel unit 20 and the key 26 receive an instruction and a setting operation from a user through a key operation and a touch operation.

The touch panel unit 20 is controlled by a touch panel control IC 19. The touch panel unit 20 is configured by a system that detects electrostatic capacitance, a system that detects a resistance value, and the like. The touch panel control IC 19 is controlled by a control signal 21 from/to the control unit 12. The control signal 21 is transmitted through, for example, a high-speed serial communication. The LCD 24, the key 26, and the LED 25 are controlled by a panel control IC 23. Communication between the panel control IC 23 and the LCD 24 is performed by high-speed parallel communication 28. Communication between the panel control IC 23 and the control unit 12 is performed by high-speed serial communication 27.

A plurality of sensors 31, 33, 35, 37, 39, and 41 are used for print control. The paper front end and rear end detection sensor 31 is a sensor that detects a timing when a sheet passes a position of the sensor. The paper front end and rear end detection sensor 31 detects a timing when the front end of the sheet arrives and a timing when the rear end of the sheet goes away. The paper front end and rear end detection sensor 31 is configured as, for example, a photo-interrupter which is a combination with a flag that is a mechanical member.

The paper conveying position detection sensor 33 is configured by, for example, a linear encoder, and detects a position, a rotation direction, and a speed of the sheet by reading a scale printed on a circular film by using a sensor. The wiper position detection sensor 35 detects a position of a wiper that has a function to maintain a state of a recording head 44 by wiping ink attached to a surface of the recording head 44. An operation of the wiper is controlled based on the position detected by the wiper position detection sensor 35 and the position detected by the paper conveying position detection sensor 33. The wiper position detection sensor 35 is configured by, for example, combining a mechanical member and a photo-interrupter.

The paper separation mechanism position detection sensor 37 is a sensor that detects an inclination angle of a mechanical member during paper feeding and is configured by a mechanical switch, for example. The recording apparatus 100 can deal with a plurality of types of media by using the paper separation mechanism position detection sensor 37. The paper feed position detection sensor 39 is configured by, for example, a linear encoder and a rotary scale in the same manner as the paper conveying position detection sensor 33, and detects a position, a rotation method, and a speed of paper feed control.

The access cover sensor 41 detects an open state of an access cover on the front surface of the apparatus in order to remove an ink tank and/or paper. When the access cover sensor 41 detects the open state, drive of the movable carriage 43 is stopped. Such a configuration prevents a user's hand from being pinched by the carriage 43.

The carriage 43 includes the recording head 44 and ink tanks 51, 52, 53, and 54 and a carriage position detection sensor 55. The carriage 43 reciprocates in a main scanning direction when rotation of the carriage motor 9 is transmitted to the carriage 43 through a belt. At this time, ink droplets are ejected from nozzles of the recording head 44, so that an image is formed. The carriage position detection sensor 55 detects a position, a direction, and a speed of the carriage 43 by reading a slit film whose operation direction is the same as that of the linear encoder.

The recording head 44 includes a heater board 45 formed by a semiconductor process and is driven by a head power supply control IC 47 based on DC power supplied from the power supply unit 2. The recording head 44 includes an ink remaining amount detection sensor 46, which detects a remaining amount of ink in a small capacity sub-tank. The ink remaining amount detection sensor 46 detects the remaining amount of ink by detecting resistance values between a plurality of pins located in the sub-tank. In this way, a control signal and the like of the ink remaining amount detection sensor 46 in addition to a signal that drives the recording head 44 are communicated between the recording head 44 and the control unit 12.

Each of the plurality of ink tanks 51, 52, 53, and 54 is provided with an IC, which stores a state of the ink tank, and each state is outputted to the control unit 12. In the embodiment, four colors of cyan (C), magenta (M), yellow (Y), and black (K) are described as recording colors. However, other colors such as special colors may be included in the recording colors.

Figure 2:
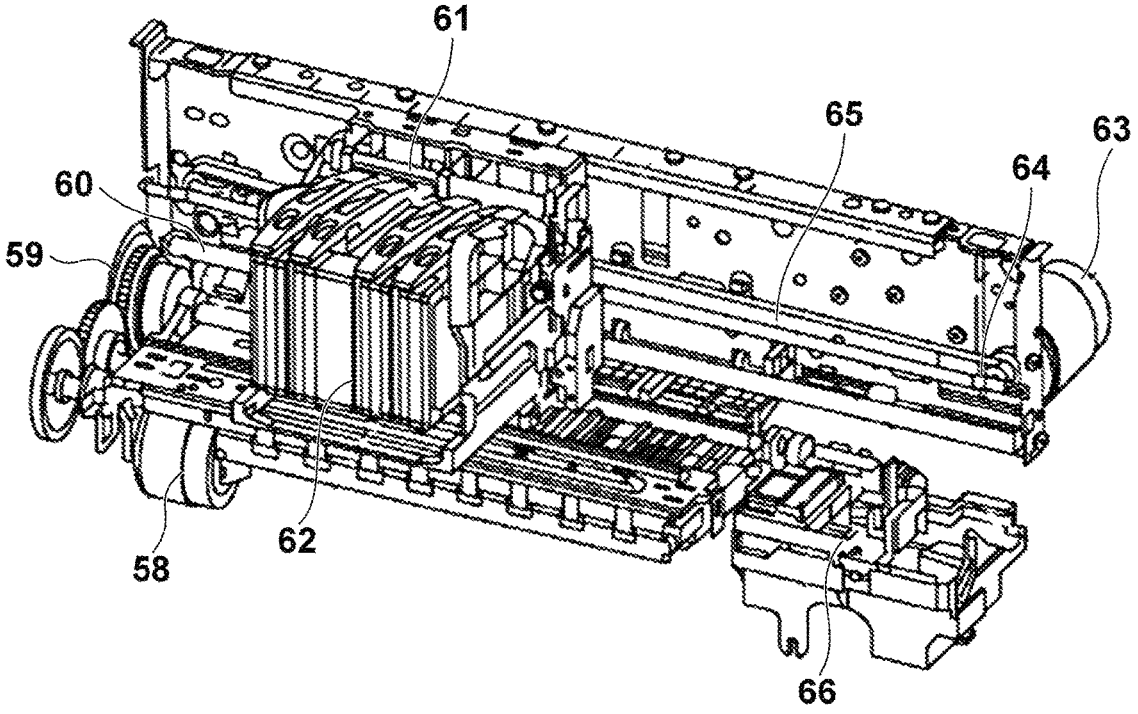
FIG. 2 is a diagram showing a configuration near a recording head.

FIG. 2 is a diagram showing a configuration near the recording head 44. FIG. 2 shows a printer engine unit of a serial type ink jet printer. Conveyance of a sheet is performed by driving a conveying motor 58. The drive of the conveying motor 58 is controlled based on a rotation direction, a position, and a speed of a conveying roller 60, which are detected by an encoder 59 for the conveying motor. The sheet is conveyed by a conveyance direction distance, where recording is performed, by the conveying roller 60 driven by the conveying motor 58. A carriage 61 on which the recording head 44 is mounted is driven by a carriage motor 63. The carriage 61 corresponds to the carriage 43 in FIG. 1. Drive of the carriage motor 63 is controlled based on a moving direction, a position, and a speed detected by a carriage encoder sensor mounted on the carriage 61 and a carriage encoder scale 64. The carriage motor 63 corresponds to the motor 9 in FIG. 1. The drive of the carriage motor 63 is transmitted to the carriage 61 through a belt 65. A head maintenance unit 66 having a maintenance function of the recording head 44 prevents drying of a nozzle surface by capping the nozzle surface of the recording head 44 while the recording head 44 is not used or during a standby state.

Figure 3B:
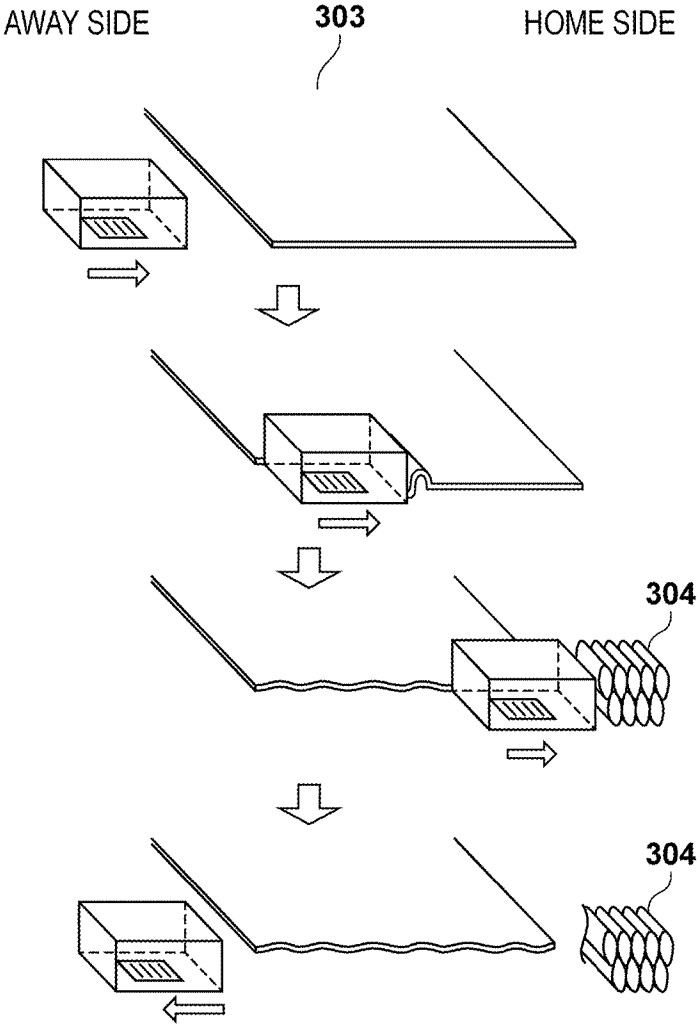
FIG. 3A and FIG. 3B are diagrams showing a phenomenon in which a paper piece is torn off due to paper jam.
Figure 3A:
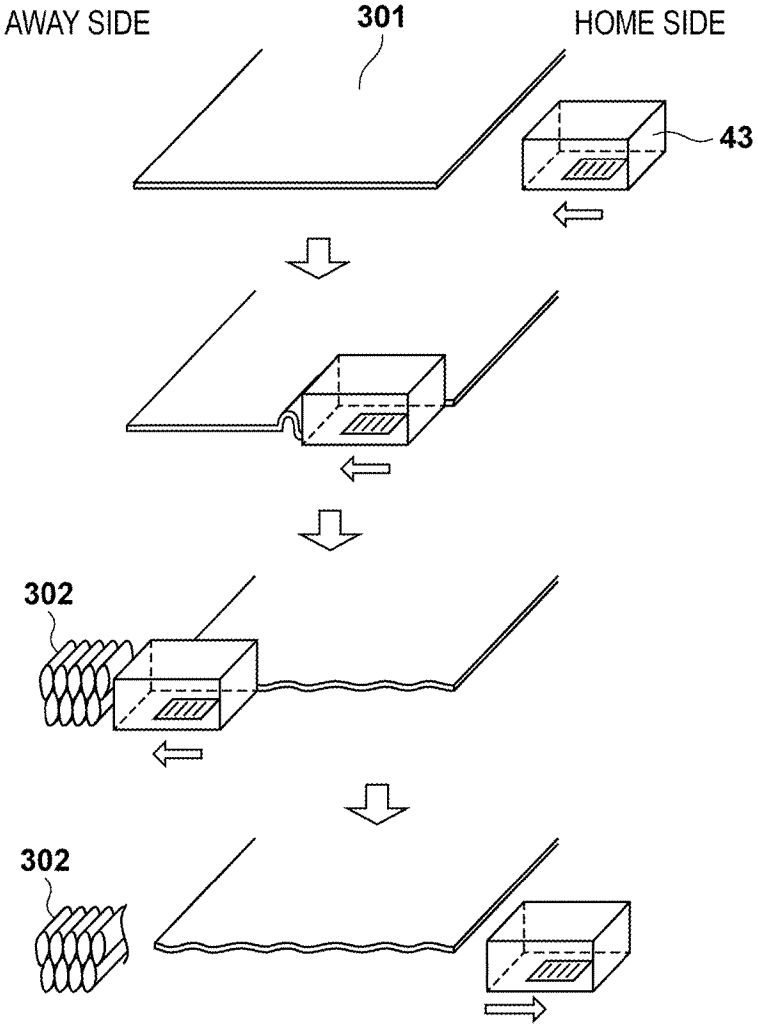

Hereinafter, a phenomenon in which a paper piece is torn by a paper jam (hereinafter referred to as a jam) will be described. FIG. 3A shows a situation where a paper piece is torn and a jam occurs when the carriage 43 moves from a HOME side (side where the head maintenance unit 66 is located) to an AWAY side (side opposite to the HOME side). FIG. 3B shows a situation where a paper piece is torn and a jam occurs when the carriage 43 moves from the AWAY side to the HOME side.

When printing is started, an area where the printing is to be performed on a sheet 301 is conveyed to a recording area of the recording head 44. In this state, the carriage 43 moves toward the sheet 301 and ink droplets are ejected from the nozzles, so that an image is recorded. At this time, if the sheet 301 is not sandwiched by the conveying roller 60 and a paper discharge roller and is bent and floated, a distance between the sheet 301 and the carriage 43 does not become constant, so that the sheet 301 and the carriage 43 collide with each other. A positional relationship between the conveying roller and the paper discharge roller will be described later. The reason why the sheet is bent is because, for example, an originally bent sheet is conveyed or the sheet is bent because the sheet and a print mode setting are not matched with each other and too many ink droplets are ejected.

When the sheet 301 and the carriage 43 collide with each other and the carriage 43 further moves, a paper piece is torn by the carriage 43. In this case, a paper piece 302 is located close to the AWAY side, and thereby a sensor error related to a mechanism function located on the AWAY side may occur. For example, a large load is applied to the carriage 43 from the paper piece, so that an error occurs where the position and/or the speed are largely deviated from expected values even though the carriage does not stop due to a motor current abnormality. Further, for example, there are a gear and the like of a paper conveying mechanism on the AWAY side, so that the position and/or the speed, which are values detected by the paper conveying position detection sensor 33, indicate abnormality, and a paper conveying motor error occurs.

Next, FIG. 3B will be described. When the printing is started, a sheet 303 is conveyed to the recording area of the recording head 44. In this state, the carriage 43 moves toward the sheet 303 and ink droplets are ejected from the nozzles, so that an image is recorded. At this time, if the sheet 303 is not sandwiched by the conveying roller 60 and the paper discharge roller and is bent and floated, a distance between the sheet 303 and the carriage 43 does not become constant, so that the sheet 303 and the carriage 43 collide with each other.

When the sheet 303 and the carriage 43 collide with each other and the carriage 43 further moves, a paper piece is torn by the carriage 43. In this case, a paper piece 304 is located close to the HOME side, and thereby a sensor error related to a mechanism function located on the HOME side may occur. For example, a large load is applied to the carriage 43 from the paper piece, so that an error occurs where the position and/or the speed are largely deviated from expected values even though the carriage does not stop due to a motor current abnormality. Further, for example, there are the head maintenance unit 66 and the like on the HOME side, so that an error of a wiper and/or a maintenance mechanism occurs.

Although common to FIGS. 3A and 3B, conveyance of a sheet is jammed by the paper piece 302 or 304, so that a feeding error of the subsequent sheet and/or an error of a separation mechanism occur. Further, a strong shock is applied to the carriage 43, so that a result of the ink remaining amount detection sensor 46 in the carriage 43 is affected and an error may be detected as a result. For example, the remaining amount of ink is detected and outputted at a timing when the shock is applied, so that an ink remaining amount detection sensor error occurs due to the shock because the ink remaining amount detection sensor 46 incidentally detects the remaining amount of ink at that timing even though there is no failure.

Generally, in each error state described above, the error is notified to a display unit or the like, so that a user is prompted to perform repair. Hereinafter, an operation of the embodiment in an error occurrence state as described above will be described. In the embodiment, after an error occurs, the carriage 43 is moved in a direction opposite to the most recent traveling direction of the carriage 43 so that the carriage 43 goes away from the paper piece 302 or 304. Such a configuration simplifies an operation for removing the paper piece 302 or 304 from the recording apparatus 100.

Figure 4:
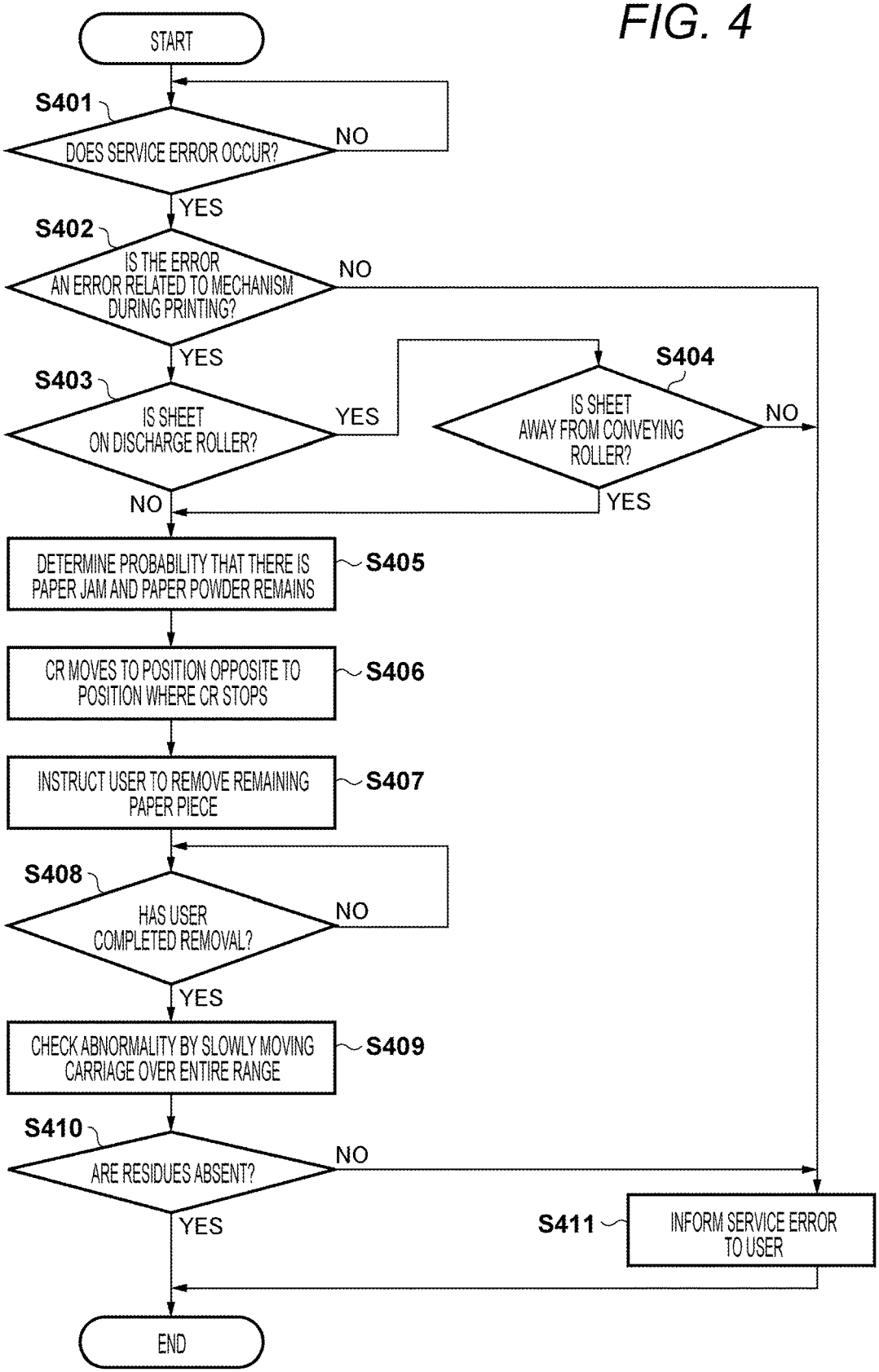
FIG. 4 is a flowchart showing control of error processing.

FIG. 4 is a flowchart showing notice control processing of error processing in the embodiment. The processing of FIG. 4 is realized when the CPU 13 reads a program stored in the ROM 14, stores the program in the RAM 15, and executes the program.

In S401, the CPU 13 monitors occurrence of a service error. Here, the service error is a general term for errors that require repair and/or maintenance because the error cannot be corrected by a user himself or herself. For example, the service error is an error when a trouble occurs in an ink supply system such as when the ink remaining amount detection sensor 46 itself fails and cannot detect the remaining amount of ink.

In S402, the CPU 13 determines whether or not the service error that has occurred is an error related to a predetermined mechanism that has occurred during printing. Here, the error related to a mechanism is, for example, a paper conveying position error, a carriage position error, a wiper position error, an ink supply system error, a paper separation mechanism error, or a head drive voltage error. In other words, these errors may be errors that have occurred due to a jam depending on a position of the sheet during printing. In S402, when the CPU 13 determines that the service error is an error related to a mechanism, the CPU proceeds to S403, and when the CPU 13 determines that the service error is not an error related to a mechanism, the CPU proceeds to S411. In S411, the CPU 13 notifies a user of a service error that requires repair and/or maintenance, and thereafter ends the processing of FIG. 4.

In S403, the CPU 13 determines whether or not the sheet reaches the paper discharge roller. For example, it is possible to determine that the front end of the sheet does not reach the paper discharge roller based on a moving amount of the sheet detected by the paper conveying position detection sensor 33 from when the front end of the sheet passes through the paper front end and rear end detection sensor 31. The paper conveying position detection sensor 33 is composed of a rotary encoder scale and a linear encoder. The paper conveying position detection sensor 33 emits transmission light to a film where printing is performed so that transmitted light varies for each pitch of a scale (for example, 360 slits per inch) and the transmitted light is detected by an optical diode. Thereby, the front end position of the sheet is known from an initial position detected by the paper front end and rear end detection sensor 31 and the moving amount of the sheet detected by the paper conveying position detection sensor 33. For example, it is assumed that a distance between the paper front end and rear end detection sensor 31 and the conveying roller 60 is 2 inches and a distance between the paper front end and rear end detection sensor 31 and the paper discharge roller is 5 inches. In this case, the number of slits corresponding to the moving amount from the initial position, that is, 720 slits (2 inches) to 1800 slits (5 inches), is a range of the front end position of the sheet. By using the above information, the front end position of the sheet is determined based on a distance to the conveying roller 60 and a distance to the paper discharge roller which are stored in advance in a non-volatile memory of the recording apparatus 100 main body. In S403, when the CPU 13 determines that the sheet reaches the paper discharge roller, the CPU 13 proceeds to S404, and when the CPU 13 determines that the sheet does not reach the paper discharge roller, the CPU 13 proceeds to S405.

In S404, the CPU 13 determines whether or not the sheet is away from the conveying roller 60. In the determination in S404, the rear end position of the sheet is known from the initial position detected by the paper front end and rear end detection sensor 31 and the moving amount of the sheet detected by the paper conveying position detection sensor 33. By using the above information, the rear end position of the sheet is determined based on the distance to the conveying roller 60 and the distance to the paper discharge roller which are stored in advance in the non-volatile memory of the recording apparatus 100 main body. In S404, when the CPU 13 determines that the sheet is away from the conveying roller 60, the CPU 13 proceeds to S405, and when the CPU 13 determines that the sheet is not away from the conveying roller 60, the CPU 13 proceeds to S411. In S411, the CPU 13 notifies the user of the service error that requires repair and/or maintenance, and thereafter ends the processing of FIG. 4. When YES in S403 and NO in S404, the sheet is pressed by both the paper discharge roller and the conveying roller 60. Therefore, in this case, it is determined that an error is caused by other than a paper jam.

A state where the sheet does not reach the paper discharge roller or a state where the sheet reaches the paper discharge roller but is away from the conveying roller 60, which is described above, is a state where the sheet is pressed by only one roller. In the embodiment, when an error related to a mechanism during printing occurs and when either one of the above states occurs, it is determined that a currently occurring error is caused by occurrence of a paper jam as shown in FIGS. 3A and 3B. In other words, in the embodiment, an error notice is controlled based on the relative position of the sheet with respect to the conveying roller 60 and the relative position of the sheet with respect to the paper discharge roller. Specifically, it is determined that an error related to a mechanism occurs because the carriage 43 tears the sheet and a residual paper piece remains as shown in FIGS. 3A and 3B. It is determined that the same goes for a case where the carriage 43 does not perfectly tear the sheet and the sheet remains.

In S406, the CPU 13 moves the carriage 43 in a direction opposite to a direction, in which carriage 43 moved most recently, from a position at which the carriage 43 stops. Such a configuration can cause a user to easily remove the residual paper piece. A preparation for removing the residual paper piece has been performed by the processing up to S406.

In S407, the CPU 13 causes, for example, a liquid crystal display unit of the touch panel unit 20 to display a message prompting a user to release a paper jam, that is, to remove the residual paper piece. FIG. 5A is a diagram showing an example of a message displayed in S407. The massage includes a message prompting the user to open an access cover.

When the user opens the access cover according to the message shown in FIG. 5A, the CPU 13 detects an open state of the access cover by the access cover sensor 41. Then, the CPU 13 displays a message prompting the user to remove the residual paper piece as shown in FIG. 5B on the liquid crystal display unit of the touch panel unit 20. The message shown in FIG. 5B includes a button for receiving an input indicating completion of removal processing when the removal processing is completed. The message shown in FIG. 5B may further display information indicating that the residual paper piece is located on the opposite side of the carriage 43.

In S408, the CPU 13 waits for pressing the button indicating completion of removal processing performed by the user. In S408, when the CPU 13 detects pressing of the button indicating completion of the removal processing performed by the user, in S409, the CPU 13 displays a message prompting the user to close the access cover as shown in FIG. 5C on the liquid crystal display unit of the touch panel unit 20.

When the user closes the access cover according to the message shown in FIG. 5C, the CPU 13 detects a closed state of the access cover by the access cover sensor 41. Then, the CPU 13 displays a message prompting the user to perform a check operation after the removal of the sheet as shown in FIG. 5D on the liquid crystal display unit of the touch panel unit 20.

In S409, the CPU 13 moves carriage 43 at a speed lower than a scanning speed during a normal recording operation over the entire recording area. The carriage 43 is driven by a driving force smaller than that during the normal recording operation, so that if a residual paper piece remains, the carriage 43 stops and the CPU 13 detects that there is a residual material.

In S410, the CPU 13 determines the presence or absence of a residual material by the processing of S409 based on whether or not the carriage 43 stops. In S410, when the CPU 13 determines that there is no residual material, the CPU 13 causes the liquid crystal display unit of the touch panel unit 20 to display a message indicating that the removal processing is normally completed as shown in FIG. 5E. Thereafter, in the same manner as the processing when normal printing is interrupted, the CPU 13 discharges a sheet that is waiting for recording from a discharge destination (discharge tray) and ends the processing of FIG. 4. On the other hand, in S410, when the CPU 13 determines that there is a residual material, the CPU 13 proceeds to S411. In S411, the CPU 13 notifies the user of a service error that requires repair and/or maintenance, and thereafter ends the processing of FIG. 4.

In the processing of FIG. 4, when the detected error is not an error related to a mechanism, or when the condition of the sheet does not satisfy a corresponding condition, or when there is a residual material even though removal processing of the sheet is performed, it is determined that a service error occurs. In S411, the CPU 13 causes the liquid crystal display unit of the touch panel unit 20 to display a message that requires repair and/or maintenance as shown in FIG. 5F.

Hereinafter, a conveyance operation of a sheet will be described with reference to FIGS. 6 to 11. FIGS. 6 to 11 are diagrams of an area around the recording head 44 viewed from a cross-section. The positions of the sheet in these diagrams are different from each other. There are the paper front end and rear end detection sensor 31 and a flag 603 of the paper front end and rear end detection sensor 31 in the following stage of a paper feeding roller 601 and a paper feeding follower roller 602. The flag 603 is supported by a spring and operates interlocking with passing and leaving of the sheet. There are the recording head 44, an ink tank 605, and a platen 606 in the following stage of the conveying roller 58 of the sheet and a follower roller 604 of the conveying roller 58. Although not shown in the drawings, the recording head 44 and the ink tank 605 are mounted on the carriage 43. A portion where there are the recording head 44, the ink tank 605, and the platen 606 corresponds to a scanning area where the carriage 43 is moved during printing. In the following stage of the portion, spurs 607 and 608 and a paper discharge roller 609 are located. In the embodiment, the paper discharge roller 609 does not have a driving source.

Figure 6:
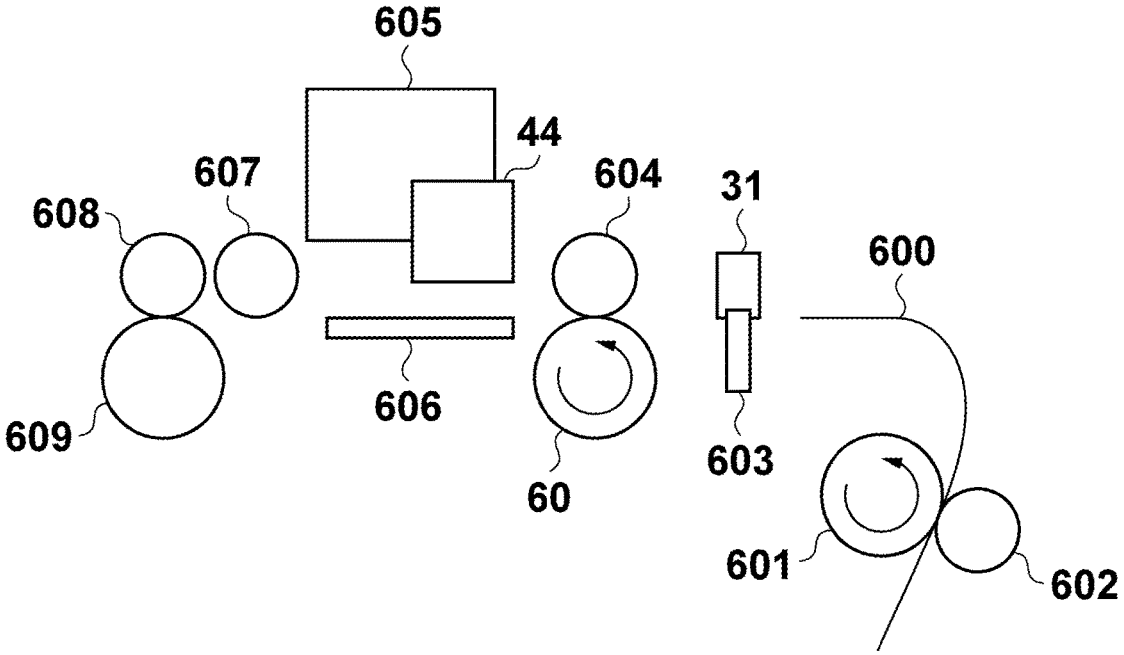
FIG. 6 is a diagram showing a conveying state of a sheet in a recording unit.

FIG. 6 shows a state from when a sheet 600 is fed from a sheet tray to when the sheet 600 is detected by the paper front end and rear end detection sensor 31. The sheet 600 is separated and conveyed from the sheet tray by the paper feeding roller 601. In the embodiment, the paper feeding is driven by a motor other than the conveying motor 58. The sheet 600 is conveyed by the paper feeding roller 601 and the paper feeding follower roller 602. The paper front end and rear end detection sensor 31 is a photo interrupter sensor, and the flag 603 blocks between a light emitting portion and a light receiving portion of the paper front end and rear end detection sensor 31 until the sheet 600 reaches the paper front end and rear end detection sensor 31.

Figure 7:
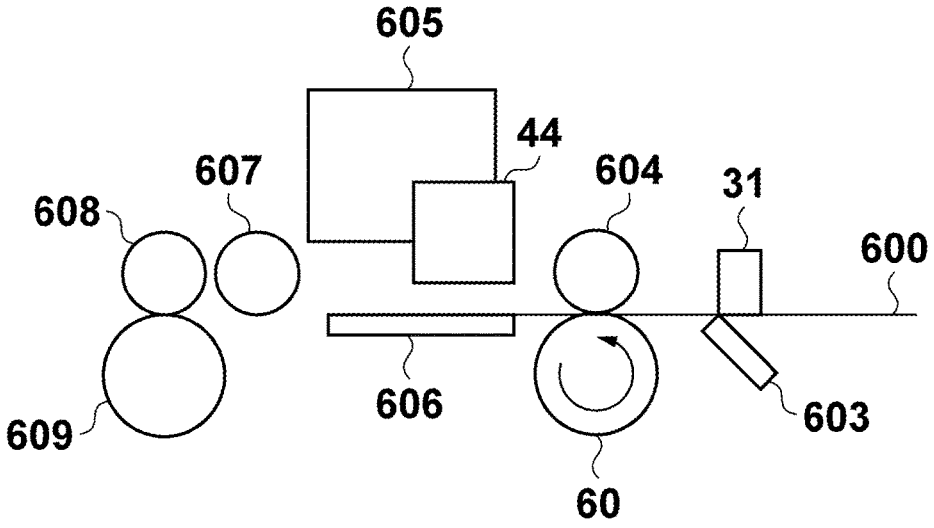
FIG. 7 is a diagram showing a conveying state of the sheet in the recording unit.

Next, FIG. 7 shows a state until when the sheet reaches the paper discharge roller 609. In FIG. 7, the paper front end and rear end detection sensor 31 is a photo interrupter sensor, and when the flag 603 sways, light transmits between the light emitting portion and the light receiving portion of the paper front end and rear end detection sensor 31, so that it is detected that the front end of the sheet has passed through the position of the paper front end and rear end detection sensor 31.

In FIG. 7, the sheet 600 is conveyed by driving the conveying roller 60, and the sheet 600 is conveyed while being sandwiched by the conveying roller 60 and the follower roller 604. The front end position of the sheet 600 is calculated from the moving amount of the paper conveying position detection sensor 33 of the conveying roller 60 from the front end detection position of the paper front end and rear end detection sensor 31. The distances from the paper front end and rear end detection sensor 31 to the conveying roller 60 and the paper discharge roller 609 are stored in advance in a non-volatile memory in the recording apparatus 100, so that the CPU 13 can identify the position of the sheet 600 by referring to information of these distances.

Figure 8:
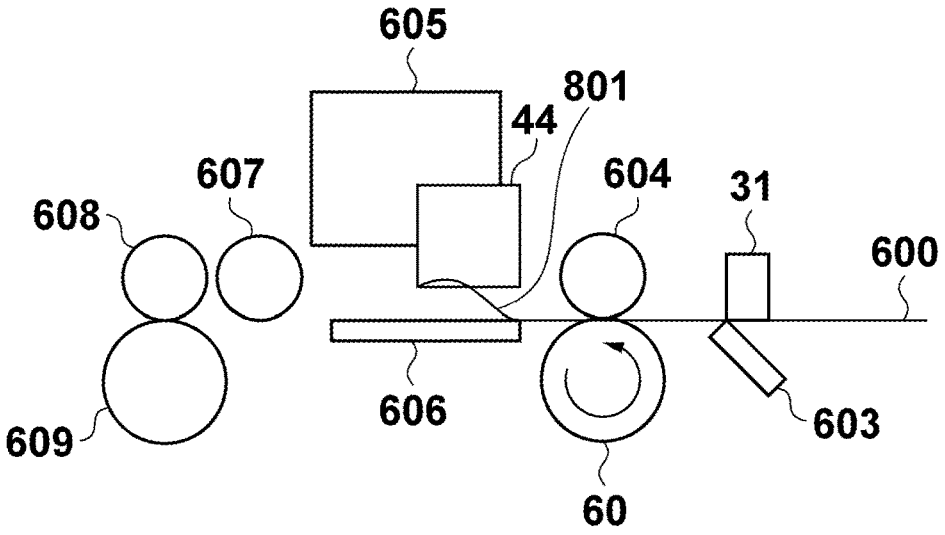
FIG. 8 is a diagram showing a conveying state of the sheet in the recording unit.

In FIG. 7, at the front end position of the sheet 600, the sheet 600 does not float from a conveying path of the sheet 600, so that the sheet 600 does not collide with the carriage 43 between the carriage 43 and the platen 606. Therefore, a jam as shown in FIGS. 3A and 3B does not occur. FIG. 8 shows a position of the same sheet 600 as that in FIG. 7. However, FIG. 8 shows a state where a front end portion 801 of the sheet 600 floats. In FIG. 7, the sheet 600 collides with the carriage 43, so that a jam of the sheet 600 occurs and the paper piece 302 or 304 as shown in FIGS. 3A and 3B remains on the platen 606.

Figure 9:
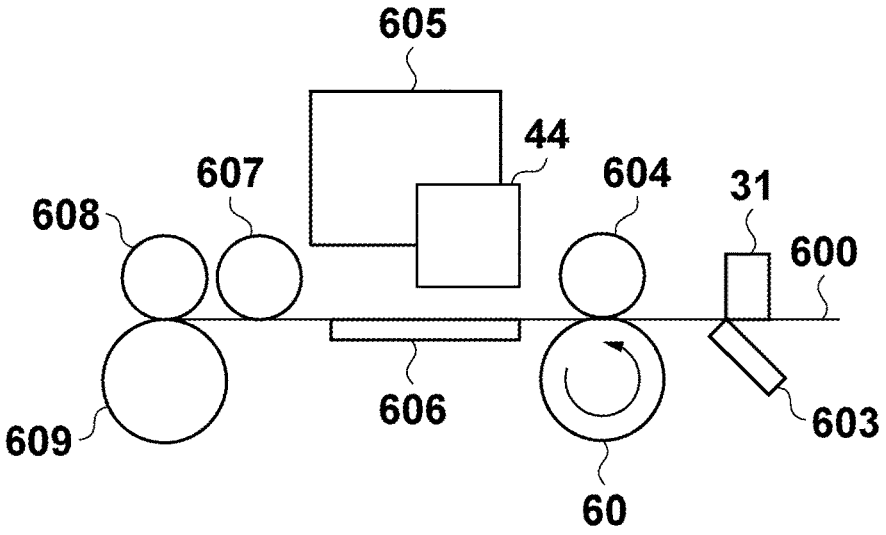
FIG. 9 is a diagram showing a conveying state of the sheet in the recording unit.

FIG. 9 shows a state where two rollers, which are the conveying roller 60 and the paper discharge roller 609, press the sheet 600. In the case of FIG. 9, the sheet 600 is fixed on the platen 606, so that it is difficult to assume that the sheet 600 collides with the carriage 43 and a jam occurs.

Figure 10:
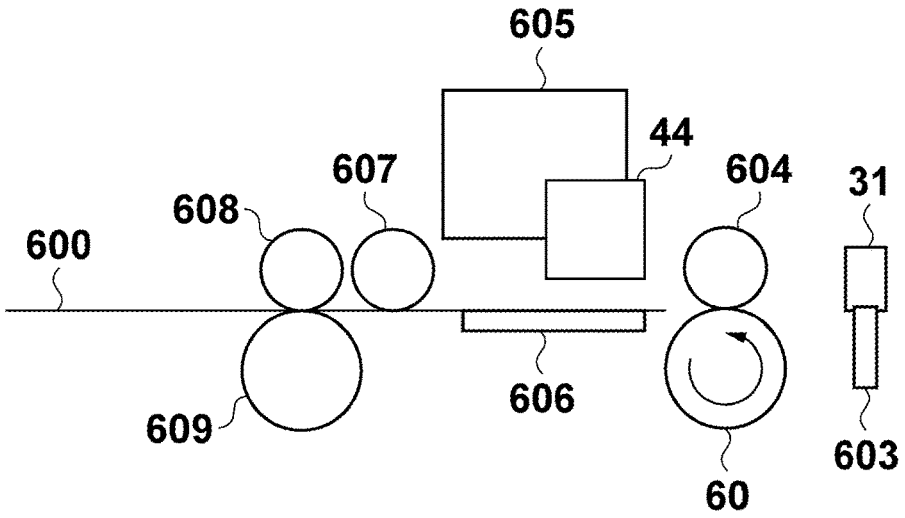
FIG. 10 is a diagram showing a conveying state of the sheet in the recording unit.
Figure 11:
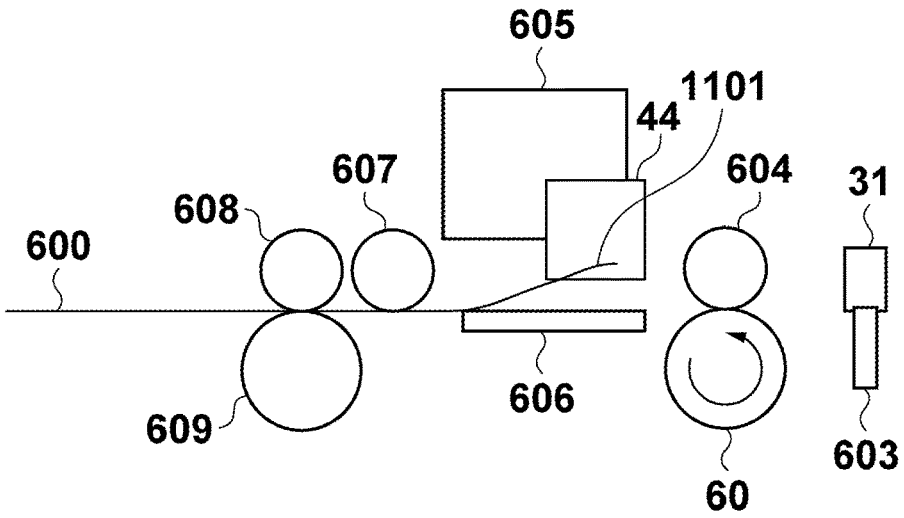
FIG. 11 is a diagram showing a conveying state of the sheet in the recording unit.

FIG. 10 shows a case where the sheet 600 is pressed by only the paper discharge roller 609. In the case of FIG. 10, the sheet 600 is pressed by only one roller and the sheet is located between the carriage 43 and the platen 606. However, the rear end of the sheet does not float. Therefore, no collision occurs and no jam of the sheet 600 occurs. On the other hand, FIG. 11 shows a state where a rear end portion 1101 of the sheet floats at the position of the sheet 600 shown in FIG. 10. In the case of FIG. 11, the carriage 43 and the sheet 600 collide with each other, so that a jam as shown in FIGS. 3A and 3B occurs.

As described above, according to the embodiment, when an error occurs during recording performed by the recording head 44, it is possible to determine whether the error is an error caused by a jam at a position where removal processing is easily performed based on the condition of the sheet and the like. By such a configuration, it is possible to prevent an error caused by a jam at a position where removal processing is difficult from being noticed as a message prompting a user to perform removal processing.

Other Embodiments

Embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present disclosure, when an error occurs during recording performed by the recording head, it is possible to notice an error caused by a jam adequately.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-051707, filed Mar. 16, 2017, which is hereby incorporated by reference herein in its entirety.

What is claimed is:

1. A recording apparatus comprising:

a recording unit configured to record an image on a sheet by causing a carriage mounted with a recording head to scan;

a plurality of rollers configured to press the sheet, wherein the plurality of rollers includes a first roller provided on an upstream side of the recording unit in a conveyance direction of the sheet and a second roller provided on a downstream side of the recording unit in the conveyance direction; and a notice control unit configured to control an error notice, wherein, in a case where the sheet is pressed by one of the first roller and the second roller, the notice control unit notices a jam error, and wherein, in a case where the sheet is pressed by both of the first roller and the second roller, the notice control unit does not notice the jam error.

2. The recording apparatus according to claim 1, further comprising a determination unit configured to determine a pressed condition of the sheet at the time of occurrence of the error based on a position of the sheet.

3. The recording apparatus according to claim 2, wherein the first roller is a conveying roller and the second roller is a paper discharge roller.

4. The recording apparatus according to claim 1, further comprising a moving unit configured to move the carriage, wherein, in a case that an error occurs, the moving unit moves the carriage in a direction opposite to a direction that the carriage is travelling when the error occurs, and wherein the notice control unit notices the jam error after the moving unit moves the carriage.

5. The recording apparatus according to claim 1, further comprising a receiving unit configured to receive information indicating that an operation to remove the error has been performed after the jam error is notified by the notice control unit.

6. The recording apparatus according to claim 5, further comprising a check unit configured to check whether there is a sheet in a scanning area of the carriage according to the receiving unit receiving the information indicating that the operation to remove the error has been performed.

7. The recording apparatus according to claim 6, wherein the check unit further is configured to check whether there is a sheet in the scanning area of the carriage by moving the carriage in the scanning area.

8. The recording apparatus according to claim 7, wherein the check unit further is configured to confirm whether there is a sheet in the scanning area of the carriage by moving the carriage in the scanning area at a speed lower than a scanning speed during a recording operation.

9. The recording apparatus according to claim 1, wherein the error includes at least either one of an error related to a conveying mechanism and an error related to a maintenance mechanism of the recording head.

10. The recording apparatus according to claim 1, wherein, in a case where the sheet is pressed by both of the first roller and the second roller, the notice control unit does not notice the jam error and notices a service error.

11. A control method for a recording apparatus having a recording unit configured to record an image on a sheet by causing a carriage mounted with a recording head to scan, a plurality of rollers configured to press the sheet, wherein the plurality of rollers includes a first roller provided on an upstream side of the recording unit in a conveyance direction of the sheet and a second roller provided on a downstream side of the recording unit in the conveyance direction, and a notice control unit configured to control an error notice, the control method comprising:

controlling, by the notice control unit and in a case where the sheet is pressed by one of the first roller and the second roller, to notices a jam error, and controlling, by the notice control unit and in a case where the sheet is pressed by both of the first roller and the second roller, to not notice the jam error.

12. The control method according to claim 11, further comprising determining a pressed condition of the sheet at the time of occurrence of the error based on a position of the sheet.

13. The control method according to claim 12, wherein the first roller is a conveying roller and the second roller is a paper discharge roller.

14. The control method according to claim 11, further comprising moving the carriage, wherein, in a case that an error occurs, moving includes moving the carriage in a direction opposite to a direction that the carriage is travelling when the error occurs, and wherein noticing by the notice control unit includes noticing the jam error after moving includes moving the carriage.

15. The control method according to claim 11, further comprising receiving information indicating that an operation to remove the error has been performed after the jam error is notified by the notice control unit.

16. The control method according to claim 15, further comprising checking whether there is a sheet in a scanning area of the carriage according to receiving the information indicating that the operation to remove the error has been performed.

17. The control method according to claim 16, wherein checking further includes checking whether there is a sheet in the scanning area of the carriage by moving the carriage in the scanning area.

18. The control method according to claim 17, wherein checking further includes confirming whether there is a sheet in the scanning area of the carriage by moving the carriage in the scanning area at a speed lower than a scanning speed during a recording operation.

19. The control method according to claim 11, wherein the error includes at least either one of an error related to a conveying mechanism and an error related to a maintenance mechanism of the recording head.

20. The control method according to claim 11, wherein, in a case where the sheet is pressed by both of the first roller and the second roller, controlling to notice, by the notice control unit, to not notice the jam error and notices a service error.

* * * * *